US005975411A

United States Patent [19]

Windolph, III

[11] Patent Number: 5,975,411

[45] Date of Patent: Nov. 2, 1999

[54] COLLAPSIBLE CONTAINER

[76] Inventor: John F. Windolph, III, 16901 White Ground Rd., Boyds, Md. 20841

[21] Appl. No.: 09/182,791

[22] Filed: Oct. 30, 1998

[51] Int. Cl.[6] ..... B65D 5/355

[52] U.S. Cl. ..... 229/101; 229/117.01; 229/117.15; 229/138

[58] Field of Search ..... 229/101, 117.01, 229/117.07, 117.14, 117.15, 138; 220/666; 215/382, 900

[56] References Cited

U.S. PATENT DOCUMENTS

| | | | |
|---|---|---|---|
| 1,808,833 | 6/1931 | Brack | 229/101 |
| 2,617,559 | 11/1952 | Van Der Spek | 215/900 |
| 2,747,380 | 5/1956 | Ridnour . | |
| 3,032,253 | 5/1962 | Younger . | |
| 3,280,871 | 10/1966 | Taylor . | |
| 3,319,684 | 5/1967 | Calhoun . | |
| 4,243,171 | 1/1981 | Prin . | |
| 5,524,789 | 6/1996 | Jackman | 220/666 |
| 5,584,413 | 12/1996 | Jung | 215/382 |
| 5,762,262 | 6/1998 | Martin | 229/117.01 |

FOREIGN PATENT DOCUMENTS

| | | | |
|---|---|---|---|
| 3205751 | 8/1983 | Germany . | |
| 291737 | 7/1991 | Germany | 229/117.01 |
| 9219504 | 11/1992 | WIPO . | |

*Primary Examiner*—Gary E. Elkins
*Attorney, Agent, or Firm*—Stephen R. Greiner

[57] ABSTRACT

A collapsible container formed from a single sheet of foldable material. The container includes a bottom portion and a number of side walls extending upwardly therefrom. The side walls are provided with fold lines which permit such to be compressed onto the bottom portion prior to use. The fold lines are positioned in a manner which eliminates the need for leak-inducing cuts in the sheet for the side walls to be easily compressed or extended. A top portion extending upwardly from the side walls provides means for closing the container as well as carrying it.

5 Claims, 1 Drawing Sheet

COLLAPSIBLE CONTAINER

FIELD OF THE INVENTION

The present invention relates generally to envelopes, wrappers and paperboard boxes and, more particularly, to containers of variable volume.

BACKGROUND OF THE INVENTION

Disposable bags are commonly used to collect refuse and subsequently transport it to a landfill or incinerator. Because these bags do not support themselves in an open position when they are being filled, they must often be fastened to a rigid support like a trash can during use. Permanently retaining trash cans and other bag supports in certain locations, a confined garage for example, can be a burdensome waste of space. A need, therefore, exists for a low-cost, self-supporting product for gathering and toting refuse which requires minimal storage space prior to use.

SUMMARY OF THE INVENTION

In light of the problems associated with the disposable bags used today to collect refuse, it is a principal object of the invention to provide a container which is transported and stored in a relatively-flat, collapsed, space-saving configuration prior to use yet may be expanded to a self-supporting, high-volume configuration for filling with refuse or other materials.

It is another object of the invention to provide a container which is formed from a single sheet of foldable material wherein the fold lines provided in the sheet are positioned to reduce the need for leak-causing cuts in the sheet.

Still another object of the invention is to provide a container which may be easily closed by an integral, top portion thereby eliminating the need for draw-strings or metallic ties.

It is an object of the invention to provide improved elements and arrangements thereof in a collapsible container for the purposes described which is lightweight in construction, inexpensive to manufacture, and dependable in use.

Briefly, the container in accordance with this invention achieves the intended objects by featuring a bottom portion and a number of side walls extending upwardly therefrom. The side walls are connected to one another by zig-zag fold lines. Each of the side walls has alternatingly-spaced, inner fold lines and outer fold lines. The inner fold lines of each of the side walls connect a pair of zig-zag fold lines together and abut the outer fold lines of the adjacent side walls. A top portion is connected to the side walls for closing the top of the container and permitting it to be easily carried.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figure 1:
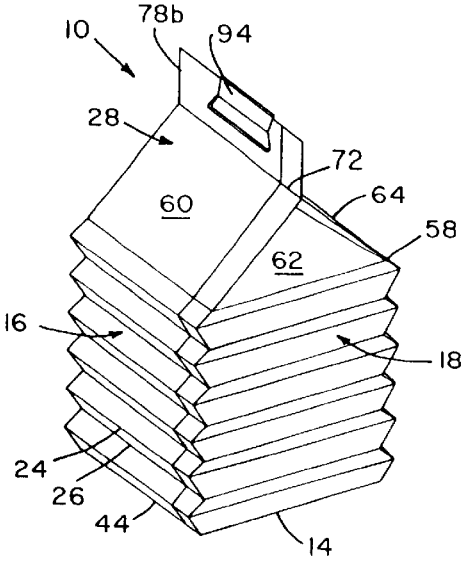
FIG. 1 is a perspective view of a collapsible container in accordance with the present invention in a closed and expanded condition.
Figure 2:
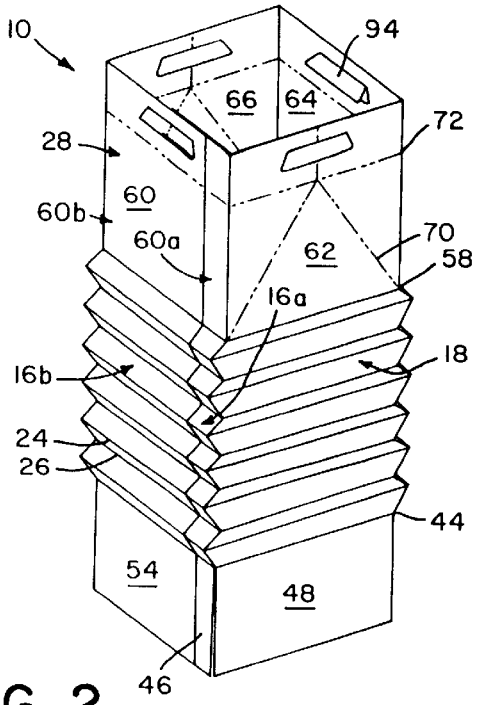
FIG. 2 is a perspective view of the collapsible container of FIG. 1 with the top and bottom portions of the container in open positions.
Figure 3:
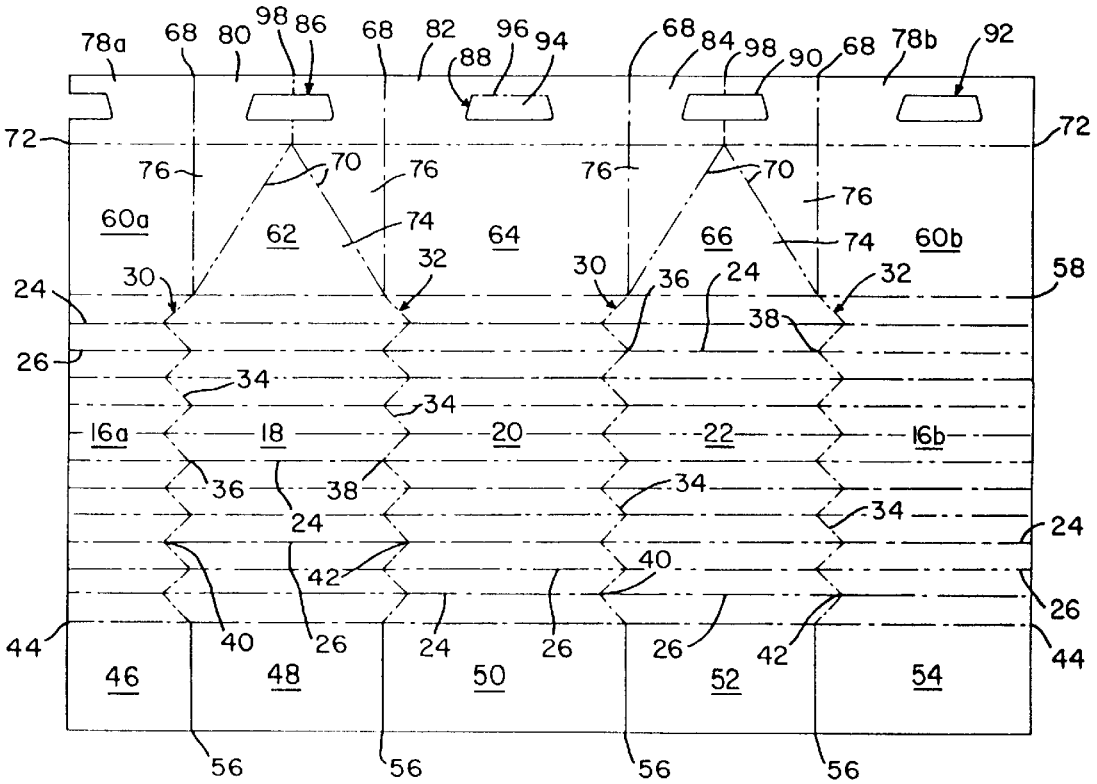
FIG. 3 is a plan view of a paperboard blank used to construct the collapsible container.

Referring now to the FIGS., a collapsible container in accordance with the present invention is shown at 10. The container 10 is preferably formed from a flat sheet or blank 12 of paperboard and includes a rectangular bottom portion 14 with four side walls 16, 18, 20 and 22 extending upwardly therefrom. Each of the side walls 16–22 has horizontal fold lines 24 and 26 which permit the container 10 to be selectively collapsed or expanded. Positioned atop the side walls 16–22 is a top portion 28 which serves to close the container 10 and as a handle.

The blank 12 includes side walls 16–22 (side wall 16 being formed by overlapping and fastening side wall portions 16*a* and 16*b*) connected by vertically-oriented, inward, i.e., opening toward the center of the container 10, zig-zag fold lines 30 and 32. Each of the fold lines 30 and 32 has a number of linear segments 34 positioned in zig-zag fashion at ninety degrees to one another. Since adjacent fold lines 30 and 32 are mirror images, together they are provided with a series of opposed points as at 36 and 38 defining the shortest distance between adjacent fold lines 30 and 32. Likewise, adjacent fold lines 30 and 32 are provided with points 40 and 42 offering the maximum horizontal distance between adjacent fold lines.

The side walls 16–22 are made collapsible and extensible by means of alternating, inward fold lines 24 and outward fold lines 26. The inward fold lines 24 connect the points 36 and 38 on adjacent fold lines 30 and 32. The outward fold lines 26, on the other hand, connect the points 40 and 42 on adjacent fold lines 30 and 32.

The vertical spacing between adjacent, inward and outward fold lines 24 and 26 is constant over the height of the side walls 16–22. Of course, there may be any number of fold lines 24 and 26 in each side wall. However, since each fold line 24 and 26 results in the collapsed container 10 having more height, it is desirable to keep the overall number of fold lines 24 and 26 to a minimum.

Connected to the lower ends of the side walls 16–22 by inward fold line 44 are flaps 46, 48, 50, 52 and 54. Flaps 46–54 are separated from each other by vertical cuts 56 in the bottom of the blank 12. During use, the flaps 46–54 are folded together and affixed to one another to form the rectangular bottom portion 14 of the container 10.

Connected to the upper ends of the side walls 16–22 by an inward fold line 58 are top walls 60, 62, 64 and 66. (The top wall 60 is formed by overlapping and fastening top wall portions 60*a* and 60*b*.) Walls 60–66 are connected by vertically-oriented, inward fold lines 68. As shown, the lower ends of the fold lines 68 correspond with the upper ends of the fold lines 30 and 32.

Extending upwardly and inwardly from the bottom of the fold lines 68 across each of the walls 62 and 66 are a pair of outward fold lines 70. The fold lines 70 converge at point on an outward fold line 72 forming the upper ends of the top walls 60–66. In doing so, the fold lines 70 divide the top walls 62 and 66 into a central portion 74 shaped like an isosceles triangle and a pair of lateral portions 76 shaped like right triangles. Bringing the tops of the lateral portions 76 of each wall 62 and 66 into abutment with one another results in the tilting of top walls 60 and 64 so that they have a roof-like pitch as shown in FIG. 1.

The pitch of the walls 60 and 64 may be varied as desired by increasing or decreasing the height of the side walls 60–66, i.e., varying the distance between the fold lines 58 and 72. In this way, a blank 12 can be formed which will allow the top portion 28 of a container 10 to be easily folded parallel with the bottom portion 14. Thus, the container can be folded flat prior to use.

Connected to the top walls 60–66 by fold line 72 are panels 78, 80, 82 and 84. (Panel 78 is formed by overlapping and fastening panel portions 78*a* and 78*b*.) Openings 86, 88, 90 and 92 are provided in the panels 78–84 which register with one another when the top portion 28 is closed as shown in FIG. 1. A tongue 94 is provided in the opening 88 which may be folded along fold line 96 and inserted through the opening 92 to provide the container 10 with a reinforced carrying handle.

It will be noted that panels 80 and 84 are provided with vertical outward fold lines 98. From the foregoing, it should be apparent that fold lines 98 permit the top walls 62 and 66 to be folded so as to fully close the top portion 28 of the container 10.

Use of the container 10 is straightforward. First, the wall portions 16*a*, 16*b*, 60*a* and 60*b* are overlapped and fastened together with glue, tape, staples or any other means. Then, the flaps 46–54 are folded into engagement with one another and fastened together thereby completing the bottom portion 14. Next, the side walls 16–22 are expanded to their full height and the container 10 is filled with refuse or other materials. When filling is complete, the top walls 60–66 are folded together to close the top portion 28. The container 10 may now be carried away with the openings 86–92 in the panels 60–66 offering a convenient handle.

While the invention has been described with a high degree of particularity, it will be appreciated by those skilled in the art that modifications may be made thereto. For example, the container 10 may be made waterproof with the addition of a wax coating to either its interior or exterior surface. Also, the container 10 can be formed of any suitable material such as plastic or aluminum foil. Therefore, it is to be understood that the present invention is not limited to the sole embodiment described above, but encompasses any and all embodiments within the scope of the following claims.

I claim:

1. A collapsible container formed from a single sheet of foldable material, said container comprising:

a bottom portion for closing the bottom of said container;

a plurality of side walls connected to said bottom portion and extending upwardly therefrom, said side walls being connected to one another by a plurality of zig-zag fold lines, each of said side walls having a plurality of alternatingly-spaced, inner fold lines and outer fold lines, said inner fold lines of each of said side walls connecting a pair of said zig-zag fold lines and abutting said outer fold lines of each of said side walls adjacent thereto; and, a top portion connected to said side walls and extending upwardly therefrom for closing the top of said container.

2. The collapsible container according to claim 1 wherein said bottom portion includes a plurality of flaps each connected to a respective one of said side walls.

3. The collapsible container according to claim 1 wherein said top portion includes a plurality of top walls connected to one another by a plurality of vertical fold lines.

4. A collapsible container formed from a single sheet of foldable material, said container comprising:

a plurality of side walls connected side-by-side by a plurality of zig-zag fold lines, each of said side walls having a plurality of alternatingly-spaced, inner fold lines and outer fold lines, said inner fold lines of each of said side walls connecting a pair of said zig-zag fold lines and abutting said outer fold lines of each of said side walls adjacent thereto;

a bottom portion for closing the bottom of said container, said bottom portion including a plurality of flaps each connected to a respective one of said side walls; and, a top portion connected to said side walls and extending upwardly therefrom for closing the top of said container, said top portion including a plurality of top walls connected to one another by a plurality of vertical fold lines.

5. A collapsible container formed from a single sheet of foldable material, said container comprising:

four side walls connected side-by-side by a plurality of zigzag fold lines, each of said side walls having a plurality of alternatingly-spaced, inner fold lines and outer fold lines, said inner fold lines of each of said side walls connecting a pair of said zig-zag fold lines and abutting said outer fold lines of each of said side walls adjacent thereto;

a bottom portion for closing the bottom of said container, said bottom portion including four flaps each connected to a respective one of said side walls; and, a top portion connected to said side walls and extending upwardly therefrom for closing the top of said container, said top portion including:

a pair of first top walls connected to a pair of said side walls positioned opposite one another;

a pair of second top walls connected to the remaining pair of said side walls and connected to said first top walls by a plurality of vertical fold lines;

a pair of first panels each respectively connected to one of said first top walls and extending upwardly therefrom;

a pair of second panels each respectively connected to one of said second top walls and extending upwardly therefrom; and, said first and second panels having openings adapted for registration with one another thereby providing said container with a handle.

* * * * *